US009190785B1

(12) United States Patent
Rogero

(10) Patent No.: US 9,190,785 B1
(45) Date of Patent: Nov. 17, 2015

(54) VERSATILE ADAPTER HAVING A MAIN BODY WITH A PLUG, A RECEPTACLE AND TWO DIFFERENT KINDS OF ADAPTERS

(71) Applicant: Gene Rogero, Watkinsville, GA (US)

(72) Inventor: Gene Rogero, Watkinsville, GA (US)

( * ) Notice: Subject to any disclaimer, the term of this patent is extended or adjusted under 35 U.S.C. 154(b) by 0 days.

(21) Appl. No.: 14/481,106

(22) Filed: Sep. 9, 2014

(51) Int. Cl.
*H01R 31/06* (2006.01)
*H01R 24/28* (2011.01)
*H01R 39/00* (2006.01)
*H01R 27/02* (2006.01)

(52) U.S. Cl.
CPC ..... *H01R 24/28* (2013.01); *H01R 27/02* (2013.01); *H01R 31/06* (2013.01); *H01R 39/00* (2013.01)

(58) Field of Classification Search
CPC ..... H01R 24/00; H01R 25/00; H01R 27/02; H01R 29/00; H01R 31/00; H01R 33/00
USPC ..... 439/638–646, 11–15, 300
See application file for complete search history.

(56) References Cited

U.S. PATENT DOCUMENTS

| | | | | | |
|---|---|---|---|---|---|
| 5,466,165 | A * | 11/1995 | Boesel et al. | ..... | 439/142 |
| 5,658,152 | A * | 8/1997 | Selker | ..... | 439/31 |
| 6,066,490 | A * | 5/2000 | Di Cosimo et al. | ..... | 435/252.1 |
| 6,736,679 | B2 * | 5/2004 | Hung | ..... | 439/651 |
| 7,497,740 | B2 * | 3/2009 | Mei et al. | ..... | 439/652 |
| 8,157,574 | B2 * | 4/2012 | Hsiao | ..... | 439/131 |
| 8,500,492 | B2 * | 8/2013 | Brown et al. | ..... | 439/638 |

* cited by examiner

*Primary Examiner* — Chandrika Prasad
(74) *Attorney, Agent, or Firm* — Smith Risley Tempel Santos LLC; Gregory Scott Smith

(57) ABSTRACT

An outlet type versatile adapter that can plug into a standard outlet, such as a wall outlet, power-strip outlet, extension cord outlet, etc. The versatile adapter includes the ability to rotate as much as 360 degrees even while plugged into an outlet. Further, the versatile adapter includes at least two adapters that can be removed and replaced with different types of interfaces. The at least two adapters can swivel between an expanded position and a closed or contacted position.

16 Claims, 9 Drawing Sheets

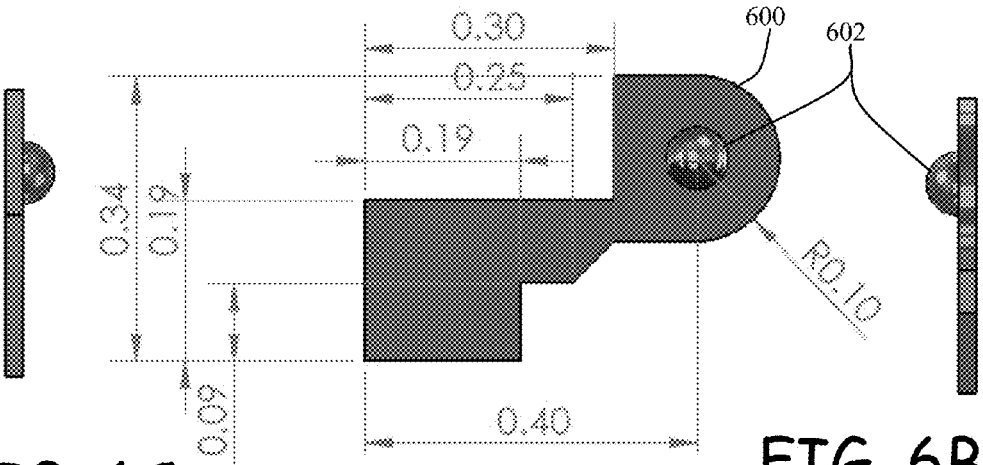
FIG. 6C
FIG. 6A
FIG. 6B
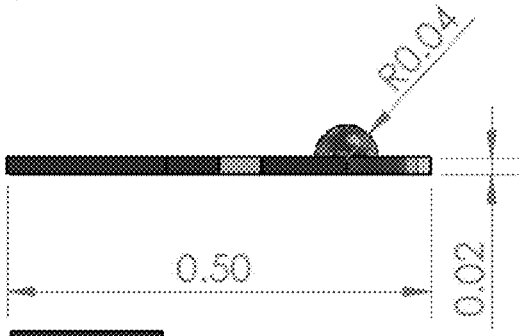
FIG. 6D
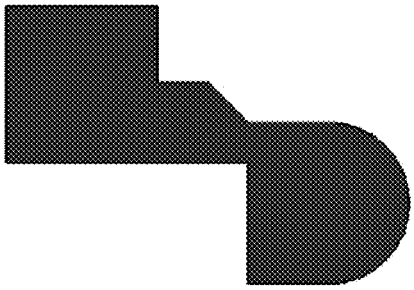
FIG. 6E
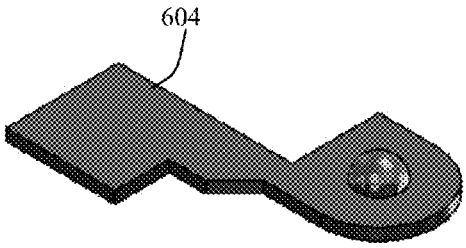
FIG. 6F

VERSATILE ADAPTER HAVING A MAIN BODY WITH A PLUG, A RECEPTACLE AND TWO DIFFERENT KINDS OF ADAPTERS

BACKGROUND

Years ago, when one packed for a trip, the main concern was a few changes of clothes and ensuring to bring sufficient amounts of underwear and socks and of course, a belt. However, the electronic age has slowly created a new and rather complex additional step to the packing process—one needs to ensure that they have the proper cables and adapters to recharge their electronic devices. Initially, this additional packing requirement was much more complicated because, almost every electronic device required a different cable and/or adapter. Fortunately, the technology giants of the world have slowly migrated to a limited number of adapters that are common between multiple devices but, once one end of the cable is inserted into such a common adapter, the other end of the cable may be any of a wide variety of connectors such as micro USB, APPLE's lighting adapter, APPLE's 30 pin adapter, as well as a wide variety of other adapters. And so, although one must ensure they have the proper charging cables, the advent of the USB connector on the opposing end of the cables has greatly simplified the number of adapters that must also be packed.

Nonetheless, when one is quite electronically dependent, you may find yourself still in need of bringing multiple adapters. In addition, there is always that pesky problem of once an adapter is inserted into an outlet, such as a wall outlet or power strip, other receptacles may be covered by the adapter or, the adapter may be oriented in a manner that is simply inconvenient.

BRIEF SUMMARY

Various embodiments presented within the description are directed towards an outlet type versatile adapter that can plug into a standard outlet, such as a wall outlet, power-strip outlet, extension cord outlet, etc. The versatile adapter includes the ability to rotate as much as 360 degrees even while plugged into an outlet. Further, the versatile adapter includes at least two adapters that can be removed and replaced with different types of interfaces. The at least two adapters can swivel between an expanded position and a closed or contacted position.

BRIEF DESCRIPTION OF THE SEVERAL VIEWS OF THE DRAWING

FIGS. 6A-6F illustrated further details of an exemplary electrical contact for a side adapter that attaches to the main body and allows the side adapter to swivel.

DETAILED DESCRIPTION OF EMBODIMENTS OF THE INVENTION

The present invention, as well as features and aspects thereof, is directed towards providing a versatile adapter that can be configured to provide multiple and different types of receptacles and/or, that can be adjusted to be more readily convenient and adaptable for receiving charging cables. The various embodiments of the versatile adapter, as well as the features and benefits thereof are presented in more detail in the following description and the accompanying drawings.

In general, it should be appreciated that each of the features, characteristics and aspects that are presented herein are not necessarily required in all embodiments of the versatile adapter. For instance, descriptions are presented for a general embodiment of a versatile adapter that includes swivel out side receptacles and that can rotate as a unitary device. However, it is anticipated that some embodiments may only include the ability for the device to rotate while other embodiments may only include the swivel out receptacles. Still other embodiments may include all of the described aspects. Thus, although these two aspects are only illustrative of the many aspects presented herein, it will be appreciated that the present disclosure anticipates any configuration of a versatile adapter that includes one or more of the aspects presented herein and, may include other aspects that are not presented herein.

Figure 1A:
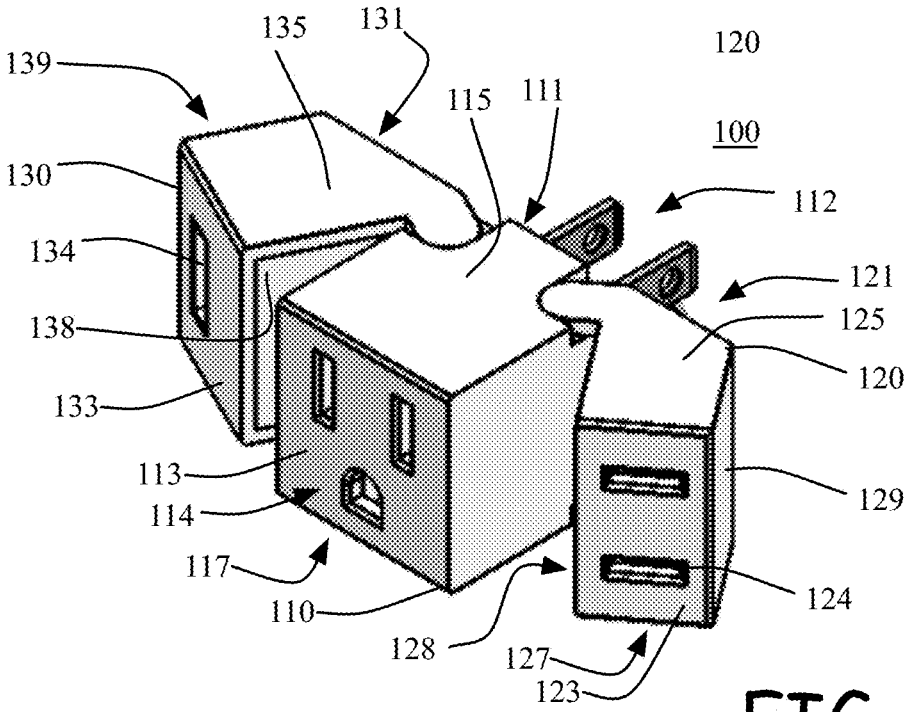
FIG. 1A is a perspective view of an exemplary embodiment of the versatile adapter residing in a first state.
Figure 1B:
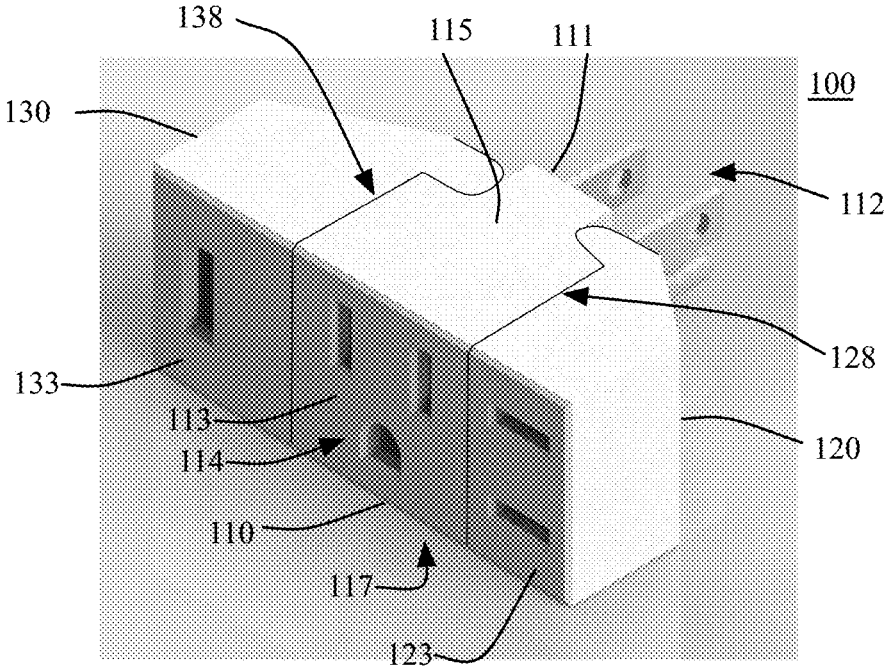
FIG. 1B is a perspective view of the exemplary adapter of FIG. 1A residing in a second state.

FIG. 1A is a perspective view of an exemplary embodiment of the versatile adapter residing in a first state. FIG. 1B is a perspective view of the exemplary adapter of FIG. 1A residing in a second state. In the illustrated embodiment, the adapter 100 is shown as including a main body 110, a first side adapter 120 and a second side adapter 130. The illustrated first and second state represent extremities of movement of the first side adapter 120 and the second side adapter 130. The state illustrated in FIG. 1A is referred to as the expanded state and the state illustrated in FIG. 1B is the contracted state. The first side adapter 120 and the second side adapter 130 can be moved independently from each other between the expanded state and the contracted state and, the side adapters can operate at any position between the two extremities.

The main body 110 is generally cube shaped, or rectangular block shaped and includes a back face 111 including a plug 112 and a front face 113 including a receptacle 114. In the illustrated embodiment, the plug 112 is shown as being a three-prong plug and the receptacle is shown as being a three-prong receptacle. However, it will be appreciated that the plug 112 can be configured to be any standard type plug, including European style plugs or any of a wide variety of other types of plugs. In addition, the receptacle of the main body can be any of a wide array of potential receptacles. In addition, the main body 110 has a top face and a bottom face. In the illustrated embodiment, the top face 115 and/or the bottom face (not visible in FIG. 1A and FIG. 1B) may include a receptacle in addition to, or in lieu of the receptacle 114. Further, the main body 110 can be extended upward and/or downward in other embodiments so as to create additional room to enable multiple receptacles to be placed on the front face 113 of the main body 110. Further, the main body 110 can also be extended outwards from the plug 112 to allow additional receptacles to be placed on the top face 115 and/or the bottom face 117 in other embodiments. Even further, the main body 110 can be extended upward and/or downward as well as outward to facilitate additional receptacles on the front face 113, top face 115 and/or bottom face 117.

The first side adapter 120 includes a back face 121, a front face 123, a top face 125, a bottom face 127, an inner face 128 and an outer face 129. Similarly, the second side adapter 130 includes a back face 131, a front face 133, a top face 135, a bottom face 137, an inner face 138 and an outer face 139. In the expanded state as illustrated in FIG. 1A, the first side adapter 120 and the second side adapter 130 are shown as being swiveled outward from the main body 110 such that the back face 121 of the first side adapter and the back face 131 of the second side adapter are parallel and on plane with the back face 111 of the main body 110. It should be appreciated that in some embodiments, the first and/or second side adapters may actual swivel beyond being on plane with the back face 111 of the main body 110.

In the expanded state, the front face 123 of the first side adapter 120 is at an outward angle from the front face 113 of the main body 110. Advantageously, in this state, the receptacle 124 of the first side adapter may be more readily accessible and, additional room is provided for plugs that may be inserted into the receptacle 114 of the main body 110 and the receptacle 124 of the first side adapter 120.

Similarly, in the expanded state, the front face 133 of the second side adapter 130 is at an outward angle from the front face 113 of the main body 110. Advantageously, in this state, the receptacle 134 of the first side adapter may be more readily accessible and, additional room is provided for plugs that may be inserted into the receptacle 114 of the main body 110 and the receptacle 134 of the second side adapter 134.

In the contracted state, the front face 123 of the first side adapter 120 is parallel to and on plane with the front face 113 of the main body 110. In addition, the inner face 128 of the first side adapter is parallel and flush with the side of the main body 110.

Similarly, in the contracted state, the front face 133 of the second side adapter 130 is parallel to and on plane with the front face 113 of the main body 110. In addition, the inner face 138 of the second side adapter is parallel and flush with the side of the main body 110.

Figure 2:
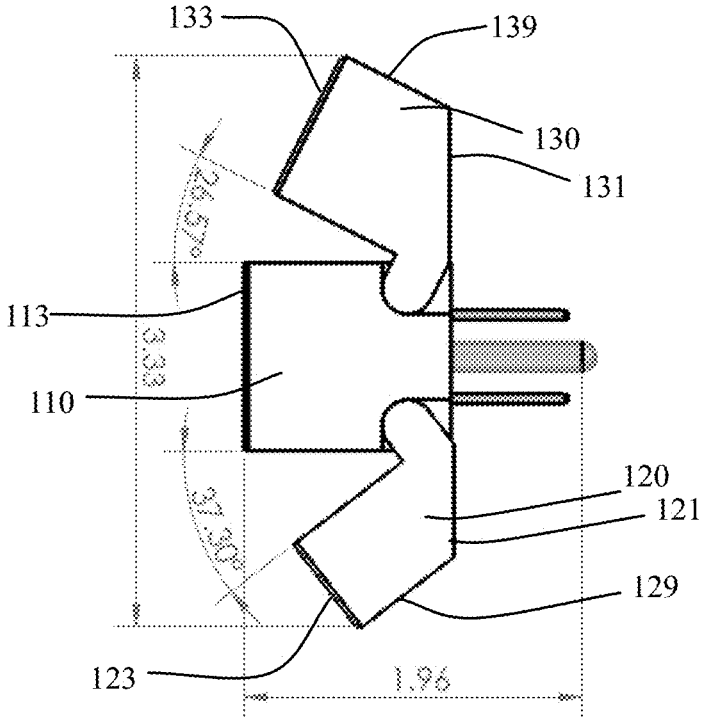
FIG. 2 is a top plan view of the embodiment of the versatile adapter illustrated in FIG. 1A and FIG. 1B.

FIG. 2 is a top plan view of the embodiment of the versatile adapter illustrated in FIG. 1A and FIG. 1B. In FIG. 2, the versatile adapter is illustrated in the expanded state. In the illustrated embodiment, the first side adapter 120 is shown as being swiveled to a displacement of approximately 37.30 degrees. In addition, the second side adapter 130 is shown as being swiveled to a displacement of approximately 26.57 degrees. The width of the illustrated versatile adapter in the expanded state is 3.33 inches. It should be appreciated that the width and relative angles of the front face 123, outer face 129 and back face 121 of the first side adapter 120, as well as the width and relative angles of the front face 133, outer face 139 and back face 131 of the second side adapter 130 determine the extent of the swivel displacement. Thus, by adjusting the dimensions of the side adapters, different degrees of displacement can be obtained and any particular measurements provided herein are simply for illustration and should not be construed as a limitation on the various embodiments. In the illustrated embodiments, the angle of rotation is approximately between 26 to 38 degrees from a side face of the main body. For side adapters of different sizes, the angle of rotation is approximately 24 to 27 degrees for one sized of adapter and approximately 35-40 degrees for another sized adapter. It will be appreciated that these rotation degrees are provided as a non-limiting example and other degrees of rotation may also be utilized, such as the range of 20-40 degrees or more.

Figure 3:
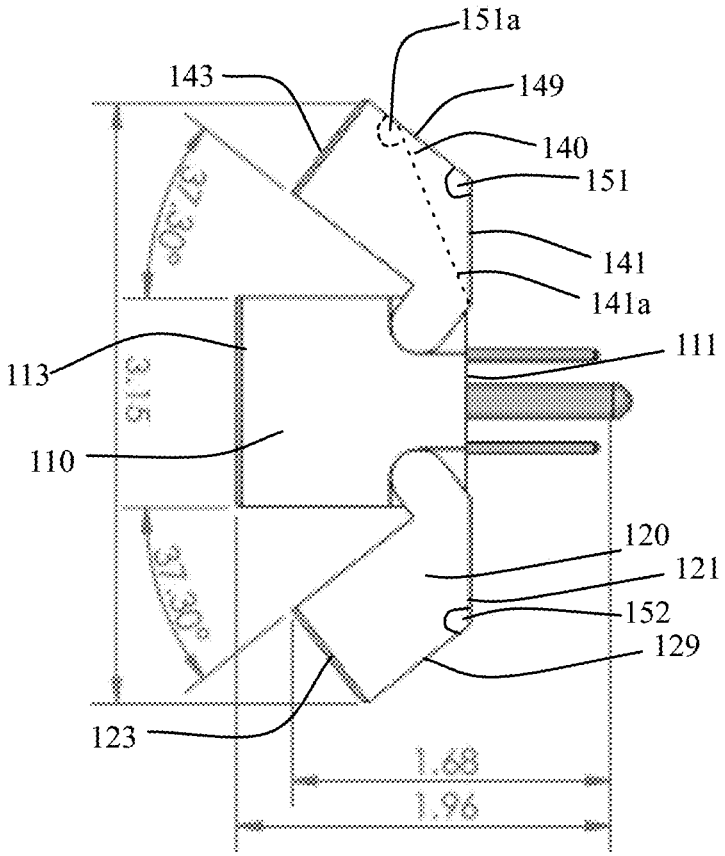
FIG. 3 is a top plan view of another embodiment of the versatile adapter.

FIG. 3 is a top plan view of another embodiment of the versatile adapter. In this embodiment, the first side adapter 120 and the second side adapter 140 have the same but mirrored dimensions. The illustrated embodiment is in the expanded mode and as such, the back face 141 of the second adapter 140 is parallel to and on plane with the back face 111 of the main body 110. The swivel displacement between the first side adapter 120 and the main body 110 is the same as that for the second side adapter 140 and the main body 110—37.30 degrees. The angle 151 between the outer face 149 and back face 141 of the second side adapter 140 and the angle 152 between the outer face 120 and the back face 121 of the first side adapter 120 are the same in the illustrated embodiment.

It will be appreciated that one technique to allow the swivel displacement of a side adapter to be changed is by changing the angle of the back face to the outer face of the side adapter. In FIG. 3, the broken line illustrated a back face 141*a* that has been lengthened and moved such that the angle 151*a* between the back face 141*a* and the outer face 149 is increased. This adjustment would allow the side adapter to swivel at a greater displacement angle.

Figure 4:
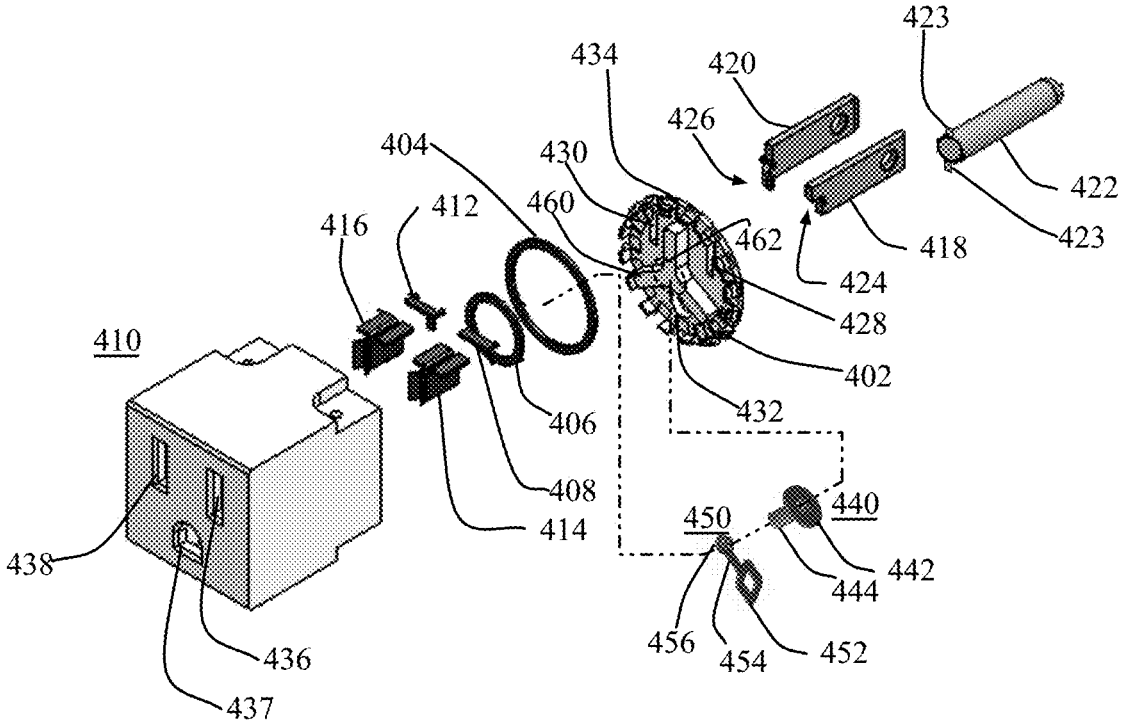
FIG. 4 is an exploded view of the interior components of the main body in an exemplary embodiment of the versatile adapter.

FIG. 4 is an exploded view of the interior components of the main body in an exemplary embodiment of the versatile adapter. In the illustrated embodiment, the main body 410 includes a rotation assembly to allow the versatile adapter to be rotated, as much as 360 degrees in some embodiments. The components of the rotation assembly include a rotating prong plate 402, an external contact ring 404, and internal contact ring 406, a first blade contact spacer 408, a second blade contact spacer 412 a first blade contact 414, a second blade contact 416, a first blade 418, a second blade 420, a ground plug 422, a center contact ferrule 440 and a spring plate 450.

The rotation assembly operates to allow the receptacle portion of the main body 410 to be rotated relative to the plug portion of main body 410. The listed components of the rotation assembly enable the plug portion of the adapter to rotate. However, some of the components remain stationary. The actual components that rotate relative to each other are listed in two groups comprising: Group 1—the rotating prong plate 402, the first blade 418, the second blade 420, the ground plug 422, and the center contact ferrule 440; Group 2—the external contact ring 404, the internal contact ring 406, the first blade contact spacer 408, the second blade contact spacer 412, the first blade contact 414, the second blade contact 416, and the spring plate 450.

In assembling the unit, not necessarily in the described order, the first blade 418 is inserted into a slot 428 of the rotating prong plate 402 and the second blade 420 is inserted into a slot 430 of the rotating prong plate 402. The first blade 418 and the second blade 420 remain in electrical isolation from each other as the rotation prong plate 402 is constructed of a non-conductive material. The first blade 418 includes a detent 424. The external contact ring 404 is inserted into the detent 424 of the first blade 418 and held in position within a receptor in the cavity defined by the receptacle portion of the main body 410 (not shown) and the rotating prong plate 402. The second blade 420 includes a contact arm 426 that mates with the internal contact ring 406. The internal contact ring 406 is also held in position relative to the rotating prong plate 402 by a receptor within the cavity of the main body 410 and the rotating prong plate 402. Thus the external contact ring 404 and the internal contact ring 406 are concentric with each other.

Further, the plug 422 is illustrated as including one or more connecting flanges 423 that extend substantially perpendicular from one end of the plug 422. The plug 422 is inserted through an aperture 432 defined by the rotating prong plate 402. The center contact ferrule 440 includes a cap or plate 442 and a hollow stem 444, the flat surface of the cap 442 is placed against the center of the rotating prong plate 402 at the point indicated by the broken line 432. At least one flange 423 of the plug 422 is in contact with the cap 442. The spring plate 450 includes an insert 456 and arm 454 and a contact plate 452. The insert 456 is inserted into the opening of the hollow stem 444 and the arm 454 extends downward. The contact plate 452 is thus positioned to be in contact with the ground fault prong of an inserted plug. When the ground fault prong is inserted, the tip pushes back the contact plate 452, which the arm 454 allows the assembly to be compliant and apply spring pressure against the tip of the ground fault prong, thus closing the circuit.

The first blade contact spacer 408 is held against the external contact ring 404 in electrical connectivity. The second blade contact spacer 412 is likewise held in electrical connectivity with the internal contact ring 406. The first blade contact spacer 408 is also held in electrical connectivity with the first blade contact 414 and the second blade contact spacer 412 is held in electrical connectivity with the second blade contact 416. A series of tabs 434 are positioned around the periphery of the rotation prong plate 402.

Thus, once the adapter is assembled, the following electrical paths are created:

Path 1: the first blade 418 is electrically connected to the external contact ring 404 at the detent 424 or alternatively the end bud of the first blade 418, the external contact ring 404 is held in electrical connectivity to the first blade contact spacer 408, which is also held in electrical connectivity with the first blade contact 414. Once a plug is inserted into the face of the assembly, a blade of the plug is inserted through slot 436 and is received into the first blade contact 414 to complete the circuit.

Path 2: the second blade 420 is electrically connected to the internal contact ring 406 at the flange 426, the internal contact ring 406 is held in electrical connectivity to the second blade contact spacer 412, which is also held in electrical connectivity with the second blade contact 416. Once a plug is inserted into the face of the assembly, a blade of the plug is inserted through slot 438 and is received into the first blade contact 416 to complete the circuit.

Path 3: the plug 422 is electrically connected to the center contact ferrule 440 as the flange 423 is connected to the cap 442, the spring plate 450 is electrically connected to the center contact ferrule 440. Once a plug is inserted into the face of the assembly, the ground fault prong of the plug is inserted through opening 437 and is forced against the contact plate 452 on the end of the arm 454 to complete the circuit.

It should be appreciated that the contacts between the components of group 1 on path 1, path 2 and path 3 (i.e. the components that do not rotate or move relative to each other) could be held in electrical connectivity by pressure, soldering or some other means. Likewise, the contacts between the components of group 2 on path 1, path 2 and path 3 (i.e. the components that do not rotate or move relative to each other) could be held in electrical connectivity by pressure, soldering or some other means.

When assembled, the tabs 434 secure the rotation prong plate 402 to the main body 410 but allow the rotation prong plate to freely rotate within the main body 410. The external contact ring 404 secures the first blade 418 by being snapped into the detent 424. Likewise, the internal contact ring 406 secures the second blade 420 into position by the contact arm 426. As the main body 410 is rotated, electrical contact is maintained between the blade 418 and the external contact ring 404 as the detent 424 slides around the external contact ring 404. Similarly, electrical contact is maintained between the second blade 420 and the internal contact ring 406 as the contact arm 426 slides along the surface of the internal contact ring 406. With electrical connectivity between the first blade 418, the external contact ring 404, the first blade contact spacer 408 and the blade contact 414, electrical connectivity is available to a blade inserted in the first slot 436 of the main body 410. Similarly, with electrical connectivity between the second blade 420, the internal contact ring 406, the second blade contact spacer 412 and the blade contact 416, electrical connectivity is available to a blade inserted in the second slot 438 of the main body 410. Thus, as the main body 410 is rotated, electrical connectivity is maintained to the receptacle of the main body 410. It should be understood then that as the main body 410 is rotated, the main body 410, the external contact ring 404, the internal contact ring 406, the first blade contact spacer 408, the second blade contact spacer 412, the first blade contact 414 and the second blade contact 416 are rotate together in fixed relationship to each other. The rotation prong plate 402, the first blade 418, the second blade 420 and the plug 422 remain stationary while the main body 410 is rotated.

Figure 5:
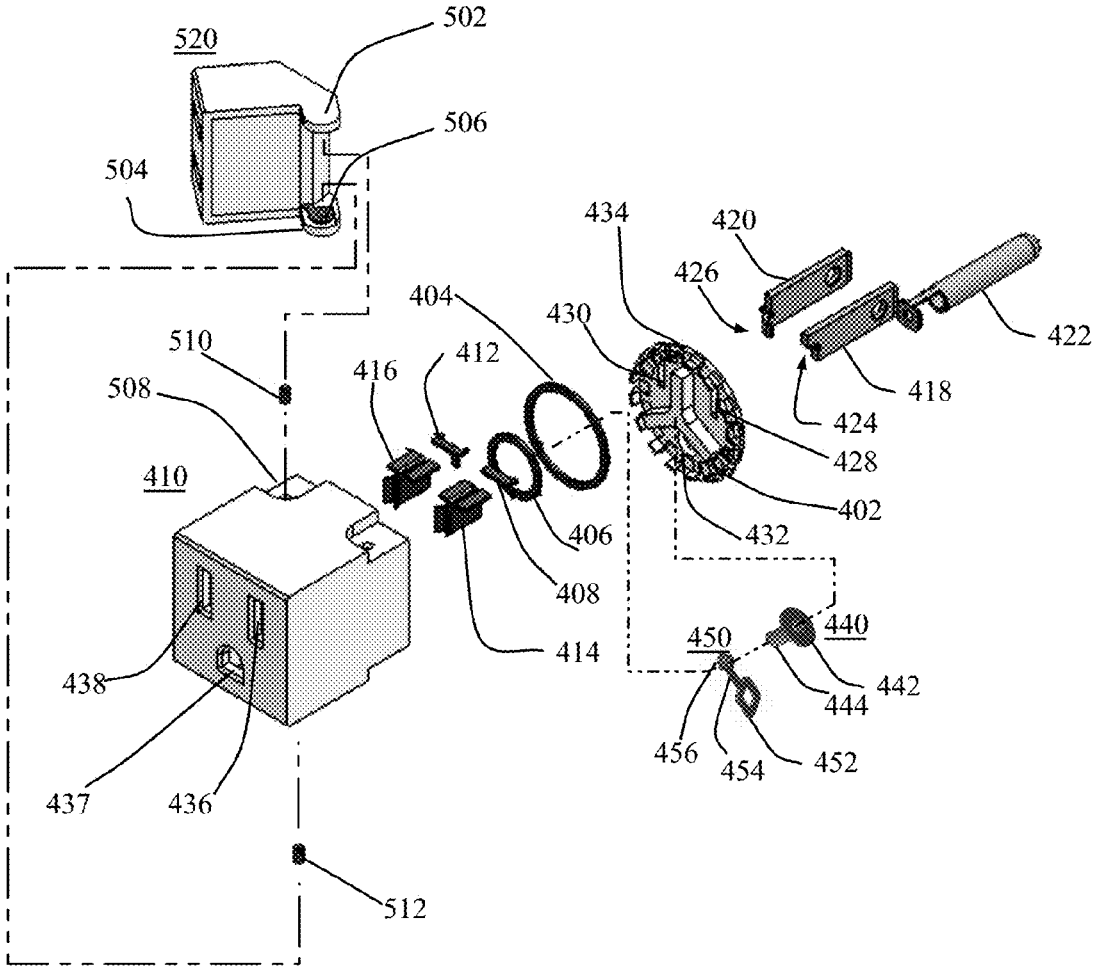
FIG. 5 illustrates an exemplary embodiment for providing electrical connectivity to the side adapters.

FIG. 5 illustrates an exemplary embodiment for providing electrical connectivity to the side adapters. Exemplary side adapter 520 includes an upper flange 502 and a lower flange 504 that mate with indentions on the top face and bottom face of the main body 410 respectively. The upper flange 502 mates with indention 508 and the lower flange 504 mates with another indention not illustrated in this view. Connectivity pin 510 is inserted through an aperture defined in the main body 410 within the indention 508 and is secured against the second blade contact spacer 412 internal to the cavity of the main body 410. Similarly, connectivity pin 512 is inserted into an aperture within the indention on the bottom face of the main body 410 (not illustrated). The interior surfaces of the flanges 502 and 504 have an electrical contact (506 for flange 504 and similarly for flange 502). The electrical contact connects internally within the side adapter to the receptacle of the side adapter and, includes a protrusion that is snapped into the aperture of the indentions of the main body 410 (such as the aperture in the indention 508 through which the pin 510 is inserted. The protrusion of the electrical contact penetrates the aperture and maintains electrical contact with the respective connectivity pin. With the protrusions being inserted into the apertures, the side adapter is free to swivel without losing electrical connectivity between the electrical contact and the respective pin.

FIGS. 6A-6F illustrated further details of an exemplary electrical contact for a side adapter that attaches to the main body and allows the side adapter to swivel. FIG. 6A is a top plan view of the electrical contact 600 and illustrates the protrusion 602. FIG. 6B is a first end view of the electrical contact 600 and FIG. 6C is an opposing end view. FIG. 6D is a side elevation view of the electrical contact 600. FIG. 6E is a bottom side view of the electrical contact 600. FIG. 6F is a perspective view of the electrical contact 600. As best illustrated in FIG. 6F, the electrical contact 600 includes a plate 604 that resides internal to the side adapter and, electrical connectivity is provided between the plate 604 and one of the contacts of a receptacle within the side adapter. It should be appreciated that the illustrated embodiment thus only illustrates two electrical connections between the main body and the side adapter. However, it is anticipate that additional connections could be provide by utilizing a pin that passes through the main body and includes isolated contacts, similar to an audio jack and, the side adapter could utilize brush contacts with the various isolated contacts to have electrical connectivity.

Figure 7:
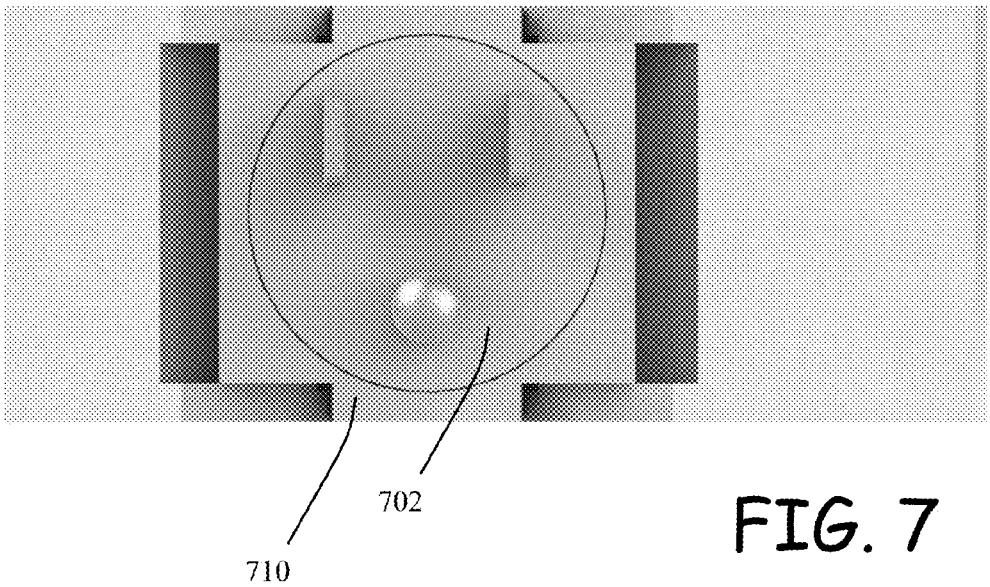
FIG. 7 is a rear view of an exemplary versatile adapter.

FIG. 7 is a rear view of an exemplary versatile adapter. In the illustrated embodiment, the rotation prong plate 702 is illustrated as being snapped into an opening in the back surface of the main body 710.

Figure 8:
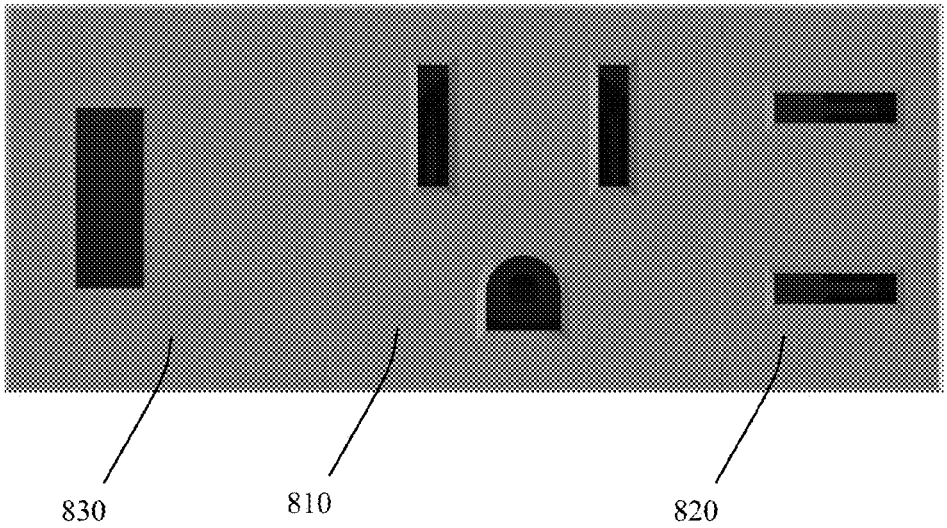
FIG. 8 is a front view of an exemplary versatile adapter.

FIG. 8 is a front view of an exemplary versatile adapter. In the illustrated embodiment, the main body 810, a first side adapter 820 and a second side adapter 830 are illustrated in the contracted state.

Figure 9:
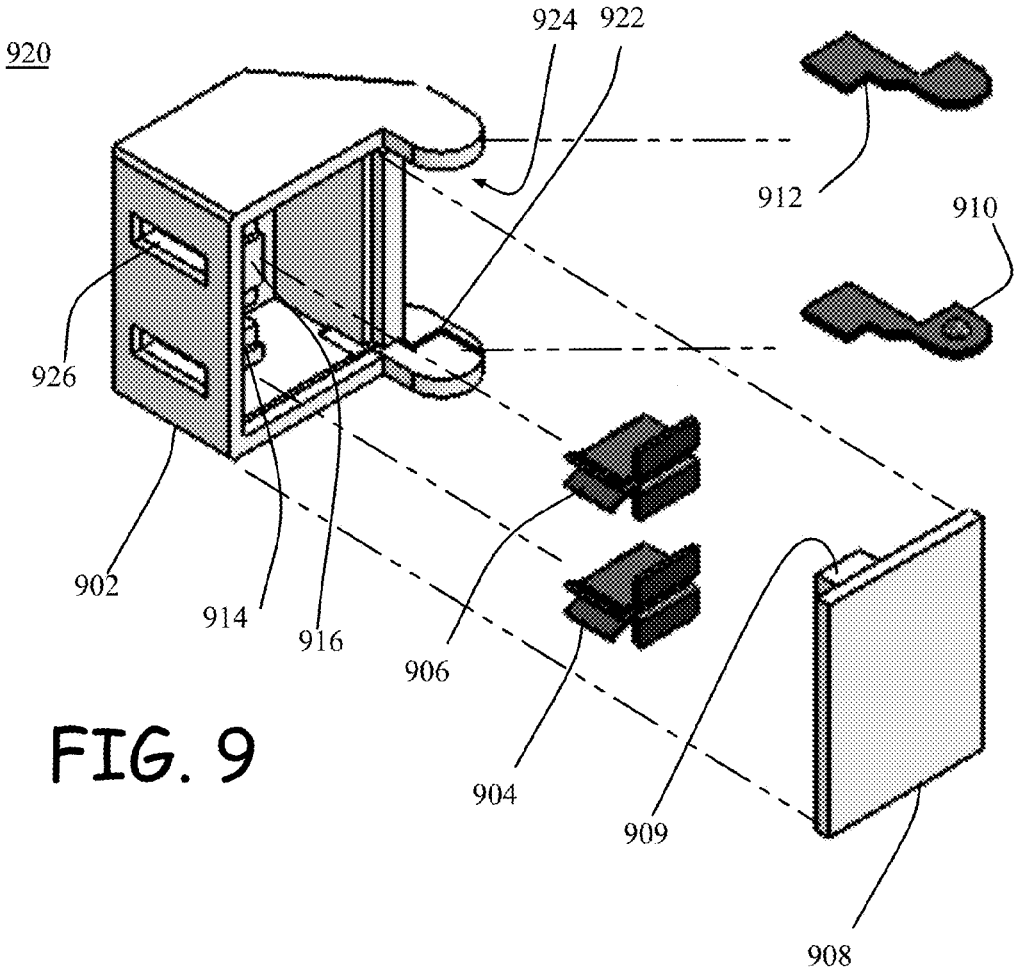
FIG. 9 is an exploded view of an exemplary side adapter configured as a two-prong plug.

FIG. 9 is an exploded view of an exemplary side adapter configured as a two-prong plug. The side adapter 920 includes a casing 902 that defines an internal cavity and two slots for receiving the blades of a two-prong plug. A first blade contact 904 and a second blade contact 906 are inserted into the cavity of the casing 902 and secured to a molded receptor 914 and 916 respectively. The receptors 914 and 916 can be any of a variety of designs including a slot into which the blade contacts can be slid, an adhesive to secure the blade contacts into position, etc. An electrical contact 910 or 912 (similar to the electrical contact 600 described in FIG. 6 as a non-limiting example) are positioned onto the interior surface of flanges 922 and 924 respectively. A portion of the electrical contacts 910 and 912 remain external to the cavity of the casing 901 as described in FIG. 6 and provide electrical connectivity with the pins in the main body of the versatile receptacle as described in FIG. 5. The remaining portion of the electrical contacts 910 and 912 are internal to the cavity of the casing 902 and are in electrical connectivity with the blade contacts 904 and 906 respectively. The electrical contacts 910 and 912 can be electrically connected to the blade contacts 904 and 906 using a variety of techniques. As a non-limiting example, wires or conductors can be soldered between the electrical contacts and the blade contacts. As another example, flanges on the blade contacts can be of sufficient length to come into contact with the electrical contacts either perpetually or, the blade contacts can expand when a blade is inserted within the blade contact thereby causing a flange to be forced against the electrical contact. A plate 908 is utilized to cover the opening into the cavity of the casing 902 once the blade contacts 904 and 906 and the electrical contacts 910 and 912 are inserted into the casing 902.

Figure 10:
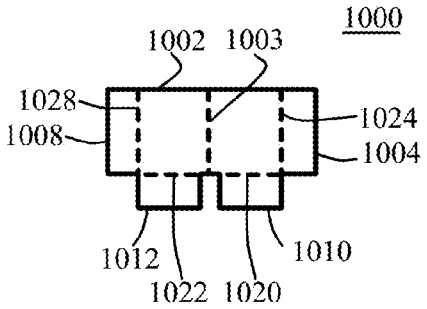
FIG. 10 is a layout diagram of a conductive pattern suitable for exemplary embodiments of blade contact.

FIG. 10 is a layout diagram of a conductive pattern suitable for exemplary embodiments of blade contact. As an exemplary and non-limiting embodiment, the blade contact (904 and 906) includes a single piece of electrically conductive material 1000 that is folded over itself along line 1003 to create a pocket like structure with a gap between the two sides of the pocket. This pocket will receive a blade. The fold is configured such that the two sides of the material are brought in close proximity such that if a blade is inserted there between, the blade causes the material to further separate and the sides of the material are spring loaded such that they assert a force against the surface of the blade thereby maintaining electrical connectivity. The blade contact further includes two flanges 1010 and 1012, which are folded away from each other at lines 1020 and 1022 respectively, at an angle approximately to 45 degrees or less. Once the flanges 1010 and 1012 are so folded, a flanged opening is created for receiving a blade and the flanged opening helps to guide the blade into the gap of the pocket. Finally, end flanges 1004 and 1008 are folded away from each other at approximately 90 degrees from the pocket. Once the material is so folded, the element 904 and 906 are created. The blade contacts 904 and 906 are then slid into a molded support located within the cavity of the casing 902. The molded support includes a slot that is aligned with the slot 226 in the casing 902. The molded support securely holds the blade contact during the pressure applied when a blade is inserted or retracted. A protrusion 909 located on the inside surface of plate 908 is structured to hold the blade contacts 904 and 906 within the slot. Finally, as a blade is inserted into the blade contacts, the flanges 1004 and 1008 and forced in opposing directions and secure contact with the electrical contacts 910 and 912.

Figure 11:
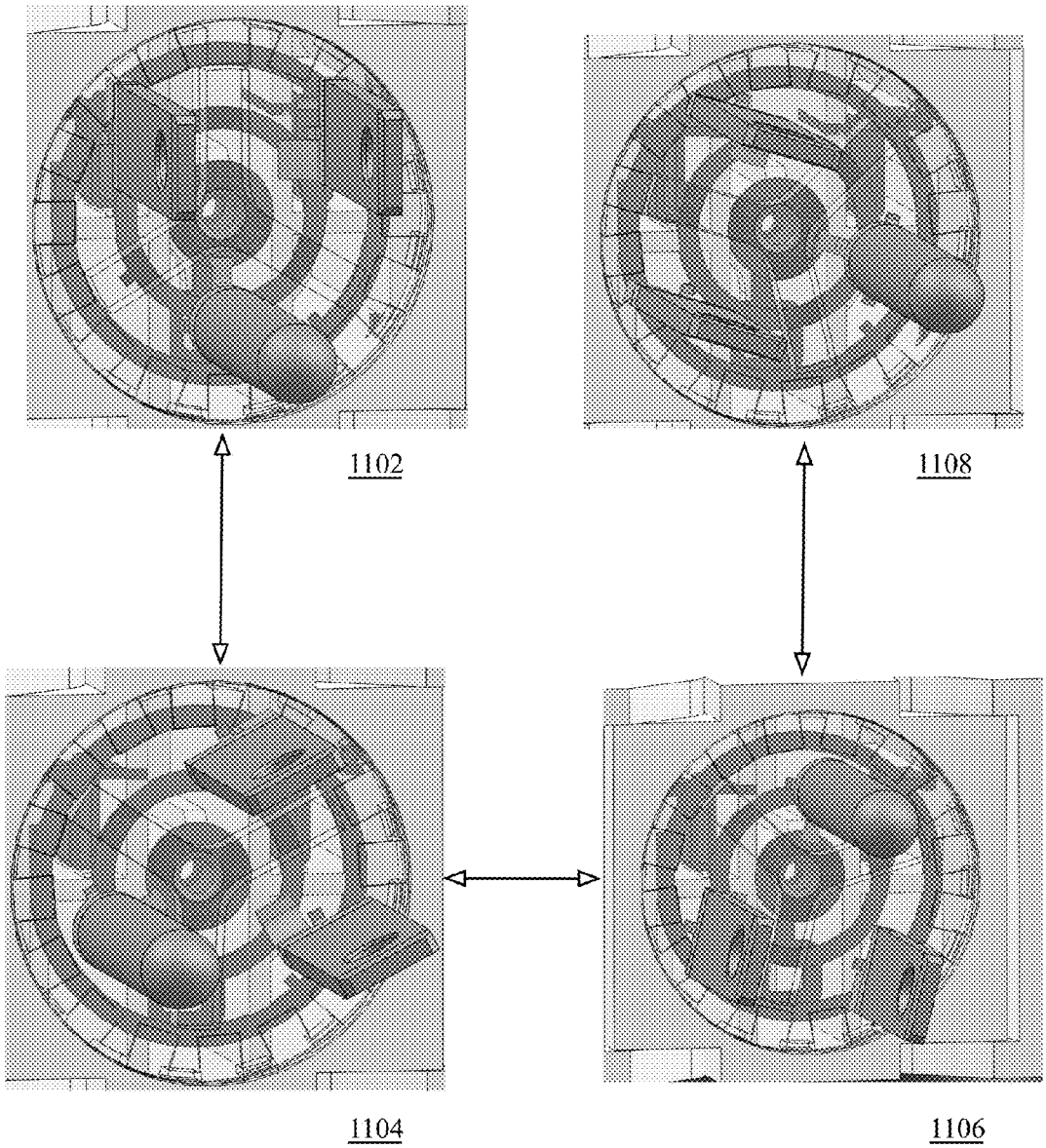
FIG. 11 is a pictorial flow diagram illustrating the rotation of the assembly through four different positions.

FIG. 11 is a pictorial flow diagram illustrating the rotation of the assembly through four different positions. At step 1102, the ground plug is located at the bottom of the assembly, which is referred to as position zero. At step 1104, the assembly is shown as being rotated approximately 45 degrees clockwise from position zero. At step 1106, the assembly is shown as being rotated approximately 190 degrees clock wise from position zero. Finally, at step 1108, the assembly is shown as being rotated approximately 315 degrees clockwise from position zero or 45 degrees counter clockwise from position zero.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

In this application the words "unit" and "module" are used interchangeably. Anything designated as a unit or module may be a stand-alone unit or a specialized module. A unit or a module may be modular or have modular aspects allowing it to be easily removed and replaced with another similar unit or module. Each unit or module may be any one of, or any combination of, software, hardware, and/or firmware.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An adapter assembly for providing electrical connectivity through a plurality of receptacles, the adapter assembly comprising:

a main body that includes a three-prong plug for insertion into a standard outlet, a three-prong receptacle, a first interface for receiving a first adapter, a second interface for receiving a second adapter and is configured to provide electrical connectivity between the standard outlet, the three-prong receptacle, the first adapter and the second adapter;

the first adapter connectable to the main body at the first interface and that provides an interface to a first type of plug, the first adapter and main body being configured to allow the first adapter to swivel laterally away from the main body;

a second adapter connectable to the main body at the second interface and that provides an interface to a second type of plug, the second adapter and main body being configured to allow the second adapter to swivel laterally away from the main body in an opposing direction to the first adapter; and a collar structure configured to allow the adapter assembly to rotate.

2. The adapter assembly of claim 1, wherein the first or second adapter includes a USB receptacle.

3. The adapter assembly of claim 1, wherein the first or second adapter includes a two-prong receptacle.

4. The adapter assembly of claim 1, wherein the first or second adapter includes one or more USB receptacles.

5. The adapter assembly of claim 1, wherein the first and second adapters can be selected from a group of adapters including at least one or more USB receptacles and a two-prong receptacle.

6. The adapter assembly of claim 1, wherein the collar structures is configured to allow the adapter assembly to rotate a full 360 degrees.

7. The adapter assembly of claim 1, wherein the first and second adapters can be removed and exchanged with other adapters.

8. The adapter assembly of claim 1, wherein the three-prong receptacle of the main body is on a front face of the main body and the main body includes a back face that is substantially parallel with the front face of the main body and two side faces that are substantially parallel to each other and substantially perpendicular to the front face and back face of the main body, and at least one of the first and second adapters include an inside face, a front face and a back face and, the at least one of the first and second adapters can swivel between a first extreme and a second extreme, wherein in the first extreme, the inside face of the at least first and second adapter is flush against the main body and the front face of the at least first and second adapter is on plane with the front face of the main body, and wherein in the second extreme, the back face of the at least first and second adapter is on plane with the back face of the main body.

9. The adapter assembly of claim 8, wherein in the second extreme, the interior face of the at least first and second adapter is approximately 26 to 38 degrees from a side face of the main body.

10. The adapter assembly of claim 8, wherein in the second extreme, the interior face of the first is between 24 and 27 degrees from a side face of the main body and the interior face of the second adapter is approximately 35-40 degrees from a side face of the main body.

11. The adapter assembly of claim 8, wherein in the second extreme, the interior face of the at least first and second adapter is approximately 20-40 degrees from a side face of the main body and, the at least first and second adapter can operate at any position between the first extreme and the second extreme.

12. An adapter assembly for providing electrical energy through a plurality of receptacles, the adapter comprising:

a main body that includes a plug for insertion into an outlet, a receptacle for receiving a plug and an interface for receiving a first adapter and a second adapter and providing electrical connectivity between the outlet and receptacle of the main body, the first adapter and second adapter;

a first adapter adjoined to the main body and that provides an interface to a first type of plug;

a second adapter adjoined to the main body and that provides an interface to a second type of plug; and the adapter assembly being configured to rotate 360 degrees.

13. The adapter assembly of claim 12, wherein at least the first or second adapter is adjoined to the main body in a manner that allows the at least first or second adapter to swivel between a first and second position, whereby the angle of access to the at least first or second adapter can be adjusted relative to the angle of access to the receptacle of the main body.

14. The adapter assembly of claim 13, wherein the at least first or second adapter can be detached from the main body and replaced with a different adapter.

15. The adapter assembly of claim 13, wherein the plug of the main body is a three-prong plug and the receptacle of the main body is a three-prong receptacle and, the first and second adapter can be selected from a group of adapters including a two-prong receptacle and a USB receptacle.

16. An adapter assembly for providing electrical energy through a plurality of receptacles, the adapter comprising:

a main body that includes a three-prong plug for insertion into a standard outlet and a three-prong receptacle and an interface for receiving a first adapter and a second adapter and providing electrical connectivity between the standard outlet and the first adapter and second adapter;

a first adapter connectable to the main body that provides an interface to a first type of plug, the first adapter and main body being configured to allow the first adapter to swivel laterally away from the main body; and a second adapter connectable to the main body that provides an interface to a second type of plug, the second adapter and main body being configured to allow the second adapter to swivel laterally away from the main body in an opposing direction to the first adapter.

* * * * *